US006450234B2

(12) United States Patent
Welfonder

(10) Patent No.: US 6,450,234 B2
(45) Date of Patent: Sep. 17, 2002

(54) HOLDER FOR A DEPENDING HOLLOW ARCHITECTURAL COVERING

(75) Inventor: Konrad Welfonder, Bremerhaven (DE)

(73) Assignee: Hunter Douglas Industries BV, Rotterdam (NL)

( * ) Notice: Subject to any disclaimer, the term of this patent is extended or adjusted under 35 U.S.C. 154(b) by 0 days.

(21) Appl. No.: 09/738,661

(22) Filed: Dec. 14, 2000

(30) Foreign Application Priority Data

Dec. 14, 1999 (EP) ..... 99204291

(51) Int. Cl.[7] ..... E06B 9/36

(52) U.S. Cl. ..... 160/178.1 V; 160/236; 160/168.1 V; 160/900; 16/87.2

(58) Field of Search ..... 160/178.1 V, 168.1 V, 160/176.1 V, 173 V, 177 V, 900, 236, 196.1; 16/87.2, 87.4 R, 94 D, 95 D, 96 D

(56) References Cited

U.S. PATENT DOCUMENTS 3,125,154 A * 3/1964 Woodle
3,137,027 A * 6/1964 Birkle
4,102,381 A * 7/1978 Bratschi
4,116,257 A * 9/1978 Bratschi
4,227,355 A * 10/1980 Wendt
4,335,775 A 6/1982 Frentzel et al. ..... 160/177
4,834,163 A * 5/1989 Dickstein
4,869,309 A 9/1989 Evans ..... 160/177
4,887,659 A * 12/1989 West
5,012,552 A * 5/1991 Wulf
5,257,811 A * 11/1993 Biba
5,303,760 A * 4/1994 Perez
5,797,442 A 8/1998 Colson et al. ..... 160/236
5,819,833 A * 10/1998 Swiszcz
6,131,243 A * 10/2000 Lee
6,289,563 B1 * 9/2001 Watkins
6,334,477 B1 * 1/2002 Moir

FOREIGN PATENT DOCUMENTS

DE 2715018 10/1978
DE 8523104 1/1986

* cited by examiner

*Primary Examiner*—Blair M. Johnson
(74) *Attorney, Agent, or Firm*—Dorsey & Whitney LLP

(57) ABSTRACT

A holder for suspending a vertical vane or the like in an architectural covering includes a male component connectible to the control system for the architectural covering and a female component connected to a vane of the architectural covering. The male and female components are releasably connected.

69 Claims, 3 Drawing Sheets

HOLDER FOR A DEPENDING HOLLOW ARCHITECTURAL COVERING

CROSS-REFERENCE TO REALTED APPLICATION

This application corresponds and claims priority to European Patent Application No. 99204291.1, filed Dec. 14, 1999 which is hereby incorporated by reference as though fully disclosed herein.

BACKGROUND OF THE INVENTION

1. Field of the Invention

This invention relates to a holder for a hollow vertical section of an architectural covering, such as a tubular flexible material for covering an architectural opening, like a window or door. This invention particularly relates to a holder for vertically arranged, hollow fabric louvers of a vertical venetian blind.

2. Description of the Relevant Art

Vertical venetian blinds have generally been provided with a longitudinally- and horizontally-extending head rail, in which there have been several carriers that can be moved along the length of the head rail. Each carrier has typically supported a vertically-extending louver in such a manner that the consumer could move the blind's louvers along the length of the head rail and also could rotate the louvers about their vertical axes. For example, carriers have each included a drive hub of a gear wheel driven by a worm gear, and the drive hub has supported a depending louver holder that has been adapted to support securely the top portions of a louver while the carrier has been moving and turning the holder and the louver. See U.S. Pat. No. 4,267,875.

Different types of louver holders have been provided in carriers for vertical blinds with solid louvers. For example, holders have held upper marginal portions of louvers: between their pairs of downwardly-extending pinching fingers (DE-Y 85 23 104, DE-A1 27 15 018 and U.S. Pat. No. 4,869,309); and also on hooks that are provided on their downwardly-extending fingers and that extend through apertures in the upper marginal portions of the louvers (U.S. Pat. No. 4,335,775).

However, such louver holders have been unsatisfactory for use with hollow vertical louvers as described in U.S. Pat. No. 5,797,442. This is because such holders have tended to squeeze together the upper marginal portions of hollow vertical louvers and, for this reason, have not maintained the tubular shape of the hollow louvers over their entire height. For this reason, the use of a hanger plate, adhesively bonded to one side of the interior of such a hollow vane has been proposed in U.S. Pat. No. 5,797,442, but this has not been an entirely satisfactory solution.

SUMMARY OF THE INVENTION

In accordance with this invention, a holder is provided for suspending a hollow vertical section of an architectural covering, such as a hollow, fabric or plastic louver of a vertical venetian blind, from a carrier of a horizontally-extending head rail; the holder comprising:

- a vertically-extending, generally cylindrical, male part having an upper portion, connected to the carrier, and a lower portion; and
- a generally inverted U-shaped, female part having a horizontal top member with a pair of parallel, downwardly-extending legs on opposite sides and a downwardly-extending hole through it; the facing surfaces of the legs each having a first detent adjacent the bottom of the legs; the first detents extending towards each other and being adapted to be inserted through apertures in opposite sides of the hollow vertical section; and wherein the lower portion of the male part is inserted in, and force fit within, the hole of the female part.

With this holder, the first detents of its female part securely hold the hollow vertical section by the apertures in the opposite sides thereof, and the male part of the holder securely holds the female part to a carrier of the head rail.

Advantageously, the top member of the female part is generally rectangular and generally planar, and it is especially advantageous that the hole in the top member is rectangular.

Also advantageously, the lower portion of the male part has:

- a radially-extending shoulder with a lower surface that extends circumferentially and horizontally around the top of the lower portion; and
- a pair of parallel planar vertical guide surfaces that are below the shoulder and or circumferentially opposite sides of the lower portion; each guide surface having, near its top, adjacent the shoulder and on circumferentially opposite sides of the lower portion, a radially-extending second detent; and upper surfaces of the second detents being horizontally coplanar.

In this regard, it is especially advantageous that the guide surfaces, on circumferentially opposite sides of the lower portion of the male part, are a pair of ramp surfaces which extend downwardly from between the upper surfaces of the second detents to the bottom of the lower portion and which curve inwardly of the lower portion as the ramp surfaces extend downwardly; and wherein the bottom portions of the ramp surfaces are parallel vertical surfaces. It is particularly advantageous that the distance between the free ends of the first detents of the female part is no more than about the distance between the bottom portions of the ramp surfaces and the bottom portions contact the free ends of the first detents when the lower portion of the male part is force fit within the hole of the female part, so as to prevent an aperture of the hollow vertical section from slipping off a first detent.

Further advantageously, the hole in the top member of the female part has:

- a width, measured between the legs, that is no less than the width, measured parallel to the guide surfaces, of a radially outer surface of the lower portion of the male part, below the lower surface of the shoulder; and
- a length, parallel to the legs, that is no more than the radial distance, measured transverse to the guide surfaces, between radially outer surfaces of the second detents.

In this regard, it is particularly advantageous that the vertical thickness of the top member of the female part, about its hole, is no more than, advantageously approximately the same as, the vertical spacing between the lower surface of the shoulder and the upper surfaces of the first detents of the male part, whereby the lower portion of the male part can be urged downwardly into the hole in the top member, so that the top member is securely held, in the assembled holder, between the upper surfaces of the second detents and the lower surface of the shoulder.

It is still further advantageous that each first detent has a generally cylindrical configuration with: i) its axis being normal to the leg, to which it is attached; a smooth outer surface; and ii) its outer diameter being less than, advantageously slightly less than, the diameter of one of the apertures, whereby the opposite sides of the hollow vertical section can slide easily apart on the pair of first detents after the first detents have been inserted in the apertures.

It is yet further advantageous that the hollow vertical section of the architectural covering is a deformable, generally tubular vane, especially a vane having three-dimensional and torsional stability along its length, particularly a vane made of a fabric having diagonal dimensional stability.

It is also advantageous that the apertures in the hollow vertical section are in opposite sides of an upper marginal portion of the hollow vertical section.

In accordance with other aspects of the invention, a head rail for an architectural covering, such as a vertical blind, and an architectural covering are provided, comprising the holder, just described.

Further aspects of the invention will be apparent from the detailed description below of a particular embodiment and the drawings thereof.

DESCRIPTION OF THE PREFERRED EMBODIMENT

Figure 1:
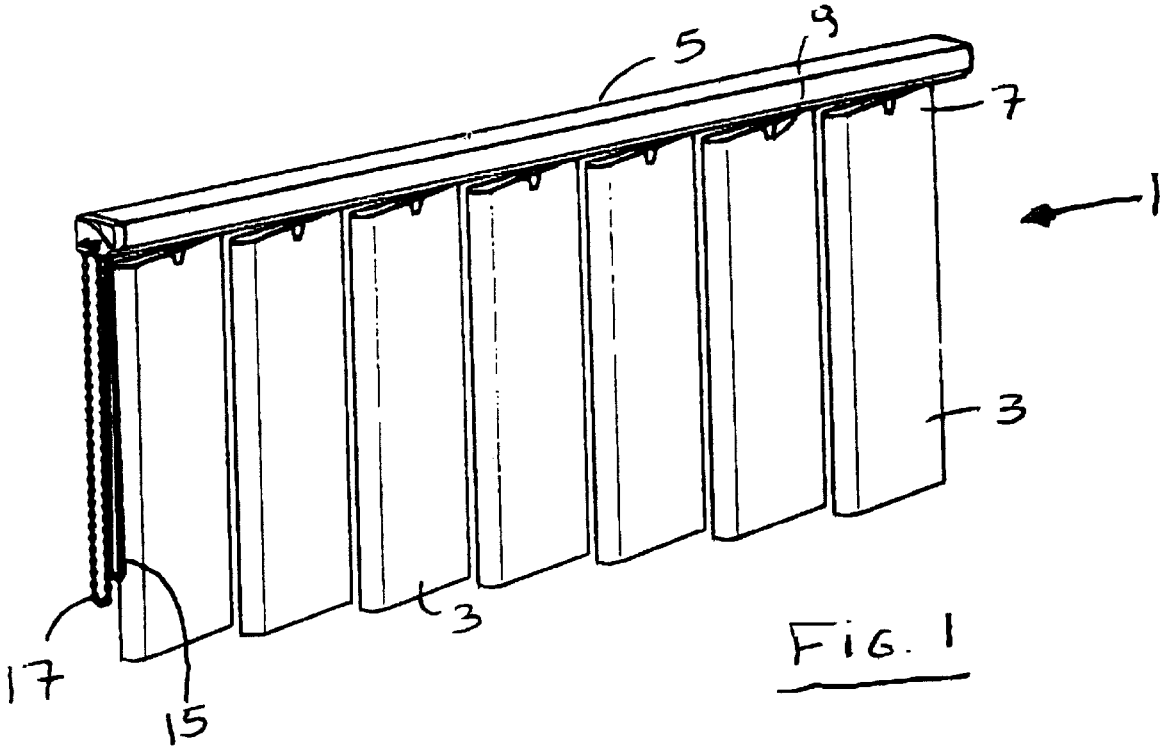
FIG. 1 is a perspective view of a vertical venetian blind with a head rail that supports a plurality of hollow vertical louvers by means of a plurality of holders of this invention.

FIG. 1 shows a vertical blind 1 having a plurality of hollow vertically-extending louvers 3 suspended from its longitudinally- and horizontally-extending head rail 5. The louvers 3, are deformable, generally tubular, plastic or fabric vanes, preferably vanes such as are disclosed in U.S. Pat. No. 5,797,442. In this regard, each louver 3 preferably has three-dimensional and torsional stability along its length and is preferably made of a fabric having diagonal dimensional stability.

Figure 2:
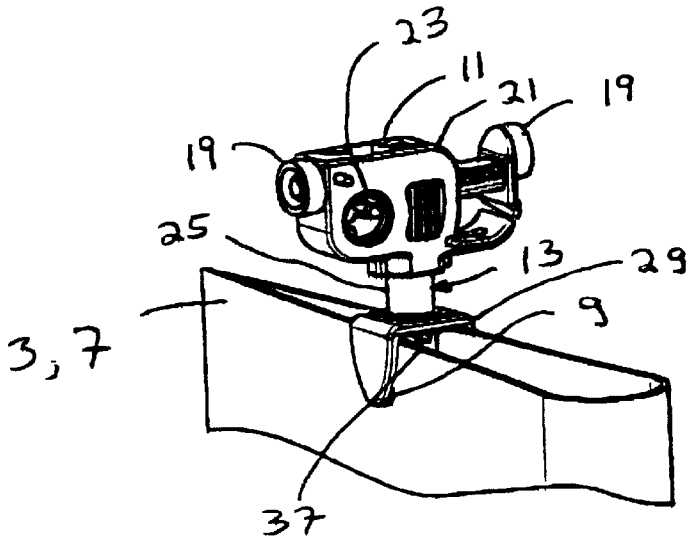
FIG. 2 is a perspective view of a carrier of the head rail of FIG. 1, supporting a single louver with a two-part holder of the invention.
Figure 3:
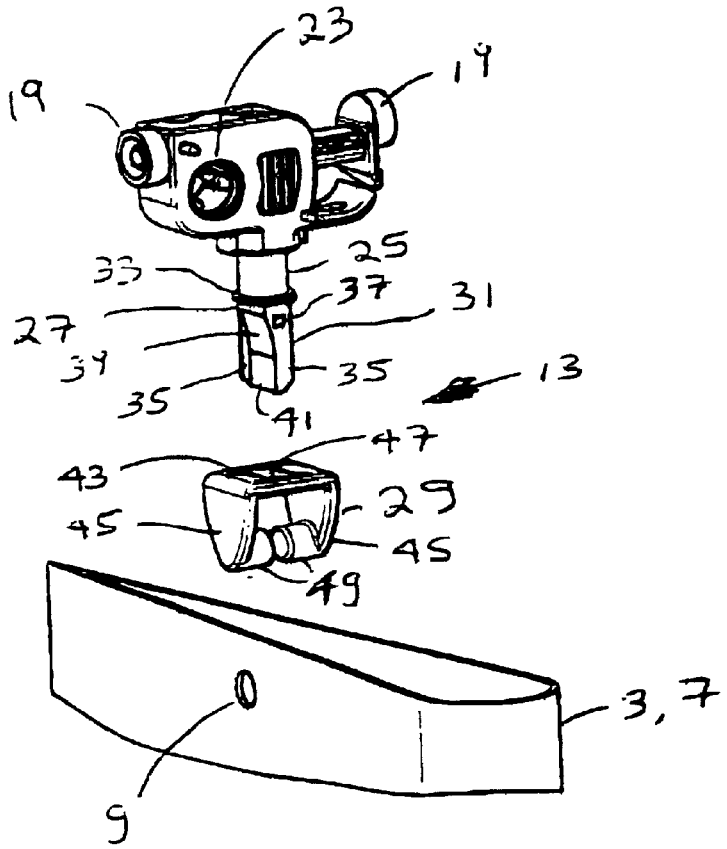
FIG. 3 is a perspective, partially exploded view of the carrier, holder and louver of FIG. 2 with the parts of the holder disengaged from each other and from the louver.
Figure 4:
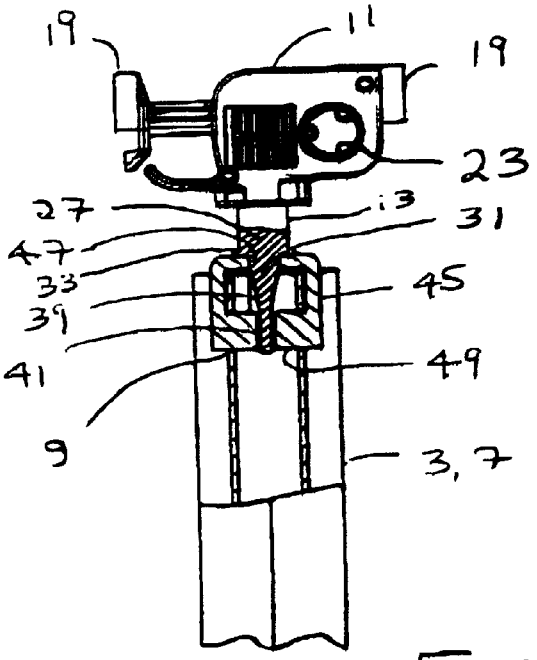
FIG. 4 is a longitudinal end view of the carrier, holder and louver of FIG. 2 with portions of the louver and holder cut away to show how the holder is secured to the louver, so that the louver maintains its tubular shape.
Figure 5:
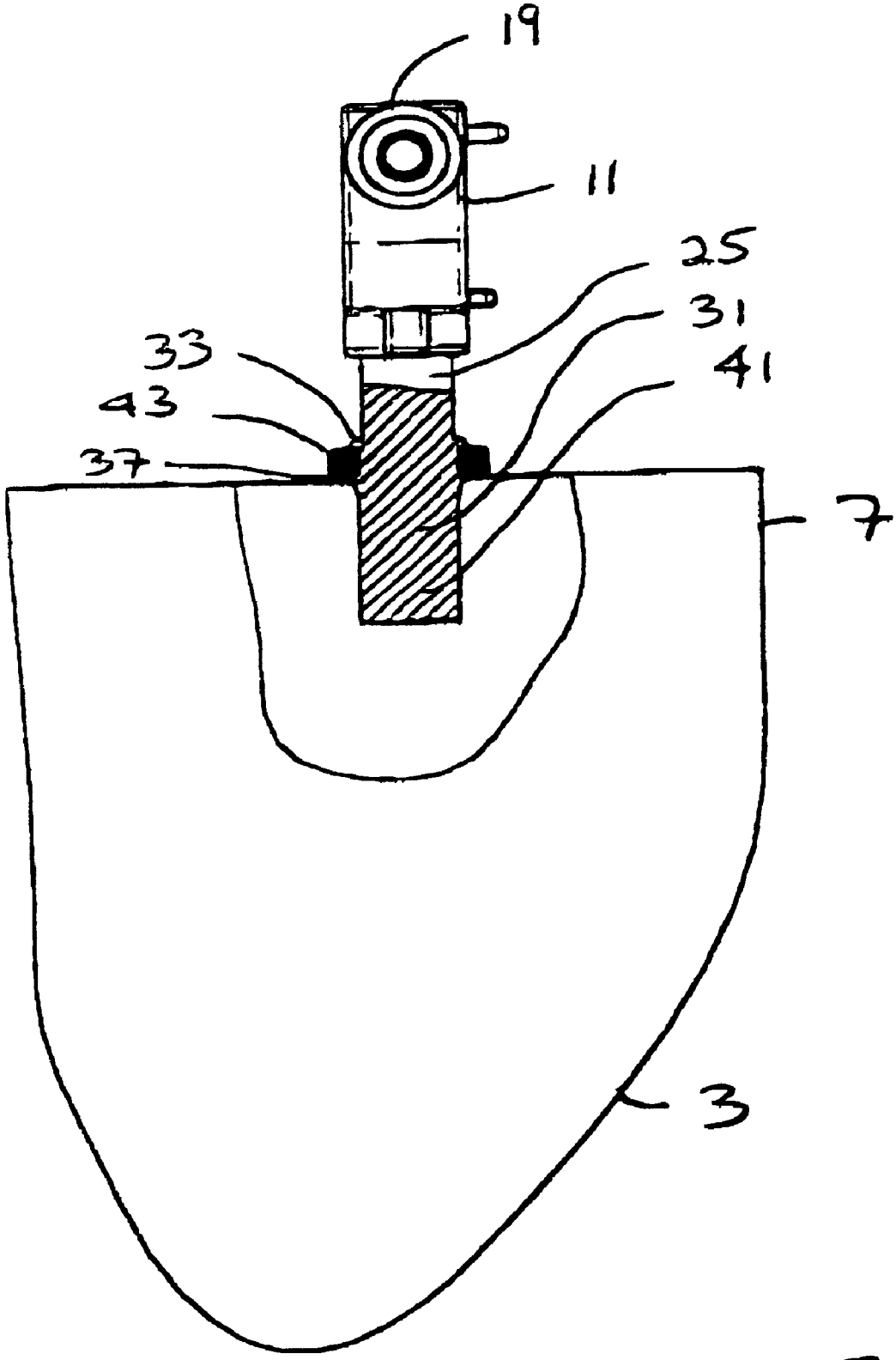
FIG. 5 a lateral view of the carrier, holder and louver of FIG. 2, with portions of the louver and holder cut away to show how the holder is secured to the louver.

In opposite lateral sides of the upper marginal portion 7 of each louver 3, as shown in FIG. 2, is a pair of apertures 9 which can be reinforced in a conventional manner against tearing. In this regard, the apertures are preferably reinforced by a thin (e.g., 0.25 mm) strip (not shown) of plastic, such as polyvinyl chloride, adhesively attached to the interior of the upper marginal portion 7 of each louver 3. As described in detail below, each louver 3 is securely suspended vertically from one of a plurality of conventional carriers, generally 11, within the head rail 5, by means of a vertically-extending two-part holder, generally 13, of this invention. The holder 13 is attached to the carrier 11 and to the apertures 9 of the louver 3 as shown in FIGS. 2–5.

The head rail 5, shown in FIG. 1, can be any conventional head rail for a vertical blind, such as the head rail generally described in U.S. Pat. No. 4,267,875. In this regard, the head rail 5 provides controlled longitudinal movement of the carriers 11 and the hollow vertical louvers 3 along the length of the head rail and controlled rotation of the louvers 3 about their vertical axes. One longitudinal side of the head rail is provided with a conventional pull cord 15 that is connected in a conventional manner to the carriers 11 for moving them longitudinally along the length of the head rail 5. The one longitudinal side of the head rail 5 is also provided with a conventional bead chain 17 for rotating a conventional, longitudinally-extending drive shaft (not shown) of the head rail which can rotate a conventional worm gear and its worm (not shown) within each carrier 11 so as to rotate the holders 13 and the louvers 3.

As shown in FIGS. 2–5, each carrier 11 in the head rail 5 carries a pair of rollers 19 on opposite lateral sides of its housing 21, so that the carriers can roll on longitudinally-extending tracks (not shown) on laterally opposite sides of the interior of the head rail 5, along its length, in response to movement of the pull cord 15. The housing 21 of each carrier 11 has a pair of openings 23 on its longitudinally opposite sides, through which the drive shaft (not shown) of the head rail 5 passes to drivingly engage the worn gear (not shown) within the housing 21, so that rotation of the drive shaft causes rotation of the worm gear and thereby rotation of a conventional drive gear (not shown) within the housing. A lower portion of the drive gear includes a hollow vertically-extending hub (not shown), into which an upper portion 25 of a vertically-extending, generally cylindrical, male part, generally 27, of the two-part holder 13 of this invention can be inserted, so that the carrier 11 supports the holder 13. The upper portion 25 of the male part 27 is a conventional upper part of a vane holder for a vertical blind as described, for example in U.S. Pat. No. 4,335,775.

As also shown in FIGS. 2–5, the holder 13 has a generally inverted U-shaped, female part, generally 29, into which a vertically-extending, lower portion 31 of the male part 27 can be inserted to hold securely a louver 3.

The lower portion 31 of the male part 27 has a radially-extending shoulder 33 with a lower surface that extends circumferentially and horizontally around the top of the lower portion 31. A pair of parallel planar vertical guide surfaces 35 are below the shoulder 33, on circumferentially opposite sides of the lower portion 31 of the male part 27. On each guide surface 35, near its top, adjacent the shoulder 33 and on circumferentally opposite sides of the lower male part portion 31, is a radially-extending first detent 37, and upper surfaces of the first detents 37 are horizontally coplanar. Between the guide surfaces 35, on circumferentially opposite sides of the lower male part portion 31, are a pair of ramp surfaces 39 which curve inwardly of the lower male part portion as the ramp surfaces extend downwardly from between the upper surfaces of the first detents 37 towards the bottom of the lower male part portion 31. Near their bottom, the ramp surfaces 39 become parallel vertical surfaces 41.

The female part 29 of the holder 13 has a generally rectangular, horizontal, generally planar, top member 43 and a pair of parallel, downwardly-extending legs 45 on opposite sides of the top member. The top member 43 has a downwardly-extending, preferably rectangular, hole 47 through it. The hole 47 has a width (measured between the legs 45) that is no less than, and preferably is greater than, the diameter (measured parallel to the guide surfaces 35) of the radially outer surface of the lower portion 31 of the male part 27, below the lower surface of the shoulder 33. The hole 47 also has a length that is about the same as, or slightly less than, the radial distance (measured transverse to the guide surfaces 35) between the radially outer surfaces of the first detents 37 on the male part. Furthermore, the vertical thickness of the top member 43, about its hole 47, is no more than, and is preferably approximately the same as, the vertical spacing between the lower surface of the shoulder 33 and the upper surfaces of the detents 37. As a result, the lower portion 31 of the male part 27 can be urged downwardly into, and thereby force fit within, the hole 47 in the top member 43 of the female part 29, so that the top member 43 of the female part is securely held, in the assembled holder 13 of this invention, between the upper surfaces of the first detents 37 and the lower surface of the shoulder 33 of the male part.

The facing surfaces of the legs 45 of the female part 29 each have a second detent 49, adjacent the bottom of the legs. The second detents 49 extend horizontally towards each other and are adapted to be inserted through the apertures 9 in one of the louvers 3, into the louver's hollow interior, to hold the louver on the holder 13 and thereby on a carrier 11 and the head rail 5. Preferably, each second detent 49 has a generally cylindrical configuration, with: i) its axis normal to the leg 45, to which it is attached; ii) a smooth outer surface; and iii) its outer diameter less than, preferably only slightly less than, the diameter of one of the apertures 9. Thereby, the opposite sides of the upper marginal portion 7 of each louver 3 can slide easily apart on the pair of second detents 49 of the female part 29 of each holder 13 after the second detents have been inserted in the apertures. In this regard, the distance between the facing free ends of the second detents 49 is sufficient to allow opposite sides of the upper marginal portion 7 of a louver 3, with its pair of apertures 9, to be pressed together, so that such opposite sides of the louver 3 can then be inserted between the free ends of the second detents until such free ends can pass freely through the apertures 9 into the hollow interior of the louver and such opposite sides of the louver 3 can then be released and allowed to return resiliently to their inherent, generally tubular configuration. However, the distance between the free ends of the second detents 49 is preferably no more than about the distance between the parallel vertical surfaces 41 at the bottom of the ramp surfaces 39 of the male part 27. This allows the parallel vertical surfaces to pass downwardly between the free ends of the second detents 49 when the lower portion 31 of the male part 27 is urged downwardly into, and thereby force fit within, the hole 47 in the top member 43 of the female part 29. As a result, the parallel vertical surfaces 41 will fill the space between the free ends of the second detents 49 to prevent one or both of the apertures 9 of a louver 3 from becoming accidentally disengaged from the second detents of the assembled holder 13.

The carriers 11 and holders 13 can be made of conventional (e.g., plastic) materials. However, it is essential that the plastic of the male part 27 and/or female part 29 of the holder 13 be sufficiently flexible and resilient, so that the lower portion 31 of the male part can be force fit within the hole 47 in the top member 43 of the female part to fold securely the top member between the first detents 37 and the shoulder 33 of the male part and thereby keep the two-part holder 13 together when, in use, it holds a depending louver 3.

The holder 13 can be used to hold securely a hollow louver 3 from a carrier 11 of the head rail 5 in a relatively simple manner. The upper marginal portion 7 of the louver 3 can be squeezed together (against the inherent resilience of the louver), so that its apertures 9 are brought together. The free ends of the second detents 49 of the female part 29 can then be inserted through the apertures 9. Then, the upper marginal portion 7 of the louver 3 can be released, so that it elastically becomes generally tubular again and its apertures 9 can slide away from each other on the second detents 49. The lower portion 31 of the male part 27 can then be pushed downwardly into the hole 47 of the top member 43 of the female part 29 to force fit the two parts together in the assembled holder 13. As a result, the parallel vertical surfaces 41 of the male part 27 contact the free ends of the second detents 49 of the female part 29 and thereby prevent the apertures 9 of the louver 3 from slipping off the second detents of the female part.

This invention is, of course, not limited to the above-described embodiments which may be modified without departing from the scope of the invention or sacrificing all of it, advantages. In this regard, the terms in the foregoing description and the following claims, such as "longitudinal", "lateral", "above", "below", "top", "bottom", "width", "length", "vertical", "horizontal", "upwardly" and "downwardly", have been used only as relative terms to describe the relationships of the various elements of the holder of the invention for a hollow vertical section of an architectural covering. For example, the continuous radially-extending shoulder 33 could be replaced by a plurality of segments of the shoulder, circumferentially spaced apart around the top of the lower portion 31 of the male part 27 of the holder 13.

What is claimed is:

1. A holder for suspending a hollow vertical section of an architectural covering, such as a hollow, fabric or plastic louver of a vertical venetian blind, from a carrier of a horizontally-extending head rail; the holder comprising:

a vertically-extending, generally cylindrical, male part having an upper portion, connected to the carrier, and a lower portion; and a generally inverted U-shaped, female part having a horizontal top member with a pair of parallel, downwardly-extending legs on opposite sides and a downwardly-extending hole through it; the facing surfaces of the legs each having a first detent adjacent the bottom of the legs; the first detents extending towards each other and being adapted to be inserted through apertures in opposite sides of the hollow vertical section; and wherein the lower portion of the male part is inserted in, and force fit within, the hole of the female part.

2. The holder of claim 1 wherein the top member of the female part is generally rectangular and generally planar.

3. The holder of claim 1 wherein the hole in the top member is rectangular.

4. A holder for suspending a hollow vertical section of an architectural covering, such as a hollow, fabric or plastic louver of a vertical venetian blind, from a carrier of a horizontally-extending head rail; the holder comprising:

vertically-extending, generally cylindrical, male part having an upper portion, connected to the carrier, and a lower portion; and a generally inverted U-shaped, female part having a horizontal top member with a pair of parallel, downwardly-extending legs on opposite sides and a downwardly-extending hole through it; the facing surfaces of the legs each having a first detent adjacent the bottom of the legs; the first detents extending towards each other and being adapted to be inserted through apertures in opposite sides of the hollow vertical section; and wherein the lower portion of the male part is inserted in, and force fit within, the hole of the female part, wherein the lower portion of the male part has (i) a radially-extending shoulder with a lower surface that extends circumferentially and horizontally around the top of the lower portion, and (ii) a pair of parallel planar vertical guide surfaces that are below the shoulder and on circumferentially opposite sides of the lower portion; each guide surface having, near its top, adjacent the shoulder and on circumferentially opposite sides of the lower portion, a radially-extending second detent; and upper surfaces of the second detents being horizontally coplanar.

5. The holder of claim 4 wherein, between the guide surfaces, on circumferentially opposite sides of the lower portion of the male part, are a pair of ramp surfaces which extend downwardly from between the upper surfaces of the second detents to the bottom of the lower portion and which curve inwardly of the lower portion as the ramp surfaces extend downwardly; and wherein the bottom portions of the ramp surfaces are parallel vertical surfaces.

6. The holder of claim 5 wherein the distance between the free ends of the first detents of the female part is no more than about the distance between the bottom portions of the ramp surfaces and the bottom portions contact the free ends of the first detents when the lower portion of the male part is force fit within the hole of the female part, so as to prevent an aperture of the hollow vertical section from slipping off a first detent.

7. The holder of claim 4 wherein the hole in the top member of the female part has:

a width, measured between the legs, that is that is no less than the diameter, measured parallel to the guide surfaces, of a radially outer surface of the lower portion of the male part, below the lower surface of the shoulder; and a length that is no more than the radial distance, measured transverse to the guide surfaces, between radially outer surfaces of the second detents.

8. The holder of claim 5 wherein the hole in the top member of the female part has:

a width, measured between the legs, that is that is no less than the diameter, measured parallel to the guide surfaces, of a radially outer surface of the lower portion of the male part, below the lower surface of the shoulder; and a length that is no more than the radial distance, measured transverse to the guide surfaces, between radially outer surfaces of the second detents.

9. The holder of claim 6 wherein the hole in the top member of the female part has:

a width, measured between the legs, that is that is no less than the diameter, measured parallel to the guide surfaces, of a radially outer surface of the lower portion of the male part, below the lower surface of the shoulder; and a length that is no more than the radial distance, measured transverse to the guide surfaces, between radially outer surfaces of the second detents.

10. The holder of claim 7 wherein the vertical thickness of the top member of the female part, about its hole, is no more than the vertical spacing between the lower surface of the shoulder and the upper surfaces of the second detents of the male part, whereby the lower portion of the male part can be urged downwardly into the hole in the top member, so that the top member is securely held, in the assembled holder, between the upper surfaces of the second detents and the lower surface of the shoulder.

11. The holder of claim 8 wherein the vertical thickness of the top member of the female part, about its hole, is no more than the vertical spacing between the lower surface of the shoulder and the upper surfaces of the second detents of the male part, whereby the lower portion of the male part can be urged downwardly into the hole in the top member, so that the top member is securely held, in the assembled holder, between the upper surfaces of the second detents and the lower surface of the shoulder.

12. The holder of claim 9 wherein the vertical thickness of the top member of the female part, about its hole, is no more than the vertical spacing between the lower surface of the shoulder and the upper surfaces of the second detents of the male part, whereby the lower portion of the male part can be urged downwardly into the hole in the top member, so that the top member is securely held, in the assembled holder, between the upper surfaces of the second detents and the lower surface of the shoulder.

13. The holder of claim 10 wherein the vertical thickness of the top member, about its hole, is, approximately the same as the vertical spacing between the lower surface of the shoulder and the upper surfaces of the second detents.

14. The holder of claim 11 wherein the vertical thickness of the top member, about its hole, is approximately the same as the vertical spacing between the lower surface of the shoulder and the upper surfaces of the second detents.

15. The holder of claim 12 wherein the vertical thickness of the top member, about its hole, is approximately the same as the vertical spacing between the lower surface of the shoulder and the upper surfaces of the second detents.

16. A holder for suspending a hollow vertical section of an architectural covering, such as a hollow, fabric or plastic louver of a vertical venetian blind, from a carrier of a horizontally-extending head rail; the holder comprising:

a vertically-extending, generally cylindrical, male part having an upper portion, connected to the carrier, and a lower portion; and a generally inverted U-shaped, female part having a horizontal top member with a pair of parallel, downwardly-extending legs on opposite sides and a downwardly-extending hole through it; the facing surfaces of the legs each having a first detent adjacent the bottom of the legs; the first detents extending towards each other and being adapted to be inserted through apertures in opposite sides of the hollow vertical section; and wherein the lower portion of the male part is inserted in, and force fit within, the hole of the female part, and wherein each first detent has a generally cylindrical configuration with: i) its axis being normal to the leg to which it is attached; ii) a smooth outer surface; and iii) its outer diameter being less than the diameter of one of the apertures whereby the opposite sides of the hollow vertical section can slide easily apart on the pair of first detents after the first detents have been inserted in the apertures.

17. The holder of claim it wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

18. The holder of claim 5 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

19. The holder of claim 6 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

20. The holder of claim 7 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

21. The holder of claim 8 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

22. The holder of claim 9 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

23. The holder of claim 10 wherein each first detent has a generally cylindrical configuration with: i) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

24. The holder of claim 11 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

25. The holder of claim 12 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

26. The holder of claim 13 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

27. The holder of claim 14 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

28. The holder of claim 15 wherein each first detent has a generally cylindrical configuration with: I) its axis being normal to the leg to which it is attached; ii) a smooth outer surface; and iii) its outer diameter being less, preferably only slightly less, than the diameter of one of the apertures whereby the opposite sides of the hollow vertical section can slide easily apart on the pair of first detents after the first detents have been inserted in the apertures.

29. A head rail for an architectural covering comprising:

the holder of any one of claims 1–3; and an elongated track for receiving the holder.

30. A head rail for an architectural covering comprising:

the holder of claim 4; and an elongated track for receiving the holder.

31. A head rail for an architectural covering comprising:

the holder of claim 5; and an elongated track for receiving the holder.

32. A head rail for an architectural covering comprising:

the holder of claim 6; and an elongated track for receiving the holder.

33. A head rail for an architectural covering comprising:

the holder of claim 7; and an elongated track for receiving the holder.

34. A head rail for an architectural covering comprising:

the holder of claim 8; and an elongated track for receiving the holder.

35. A head rail for an architectural covering comprising:

the holder of claim 9; and an elongated track for receiving the holder.

36. A head rail for an architectural covering comprising:

the holder of claim 10; and an elongated track for receiving the holder.

37. A head rail for an architectural covering comprising:

the holder of claim 11; and an elongated track for receiving the holder.

38. A head rail for an architectural covering comprising:

the holder of claim 12; and an elongated track for receiving the holder.

39. A head rail for an architectural covering comprising:

the holder of claim 13; and an elongated track for receiving the holder.

40. A head rail for an architectural covering comprising:

the holder of claim 14; and an elongated track for receiving the holder.

41. A head rail for an architectural covering comprising:

the holder of claim 15; and an elongated track for receiving the holder.

42. An architectural covering comprising the holder of any one of claims 1–3.

43. An architectural covering comprising the holder of claim 4.

44. An architectural covering comprising the holder of claim 5.

45. An architectural covering comprising the holder of claim 6.

46. An architectural covering comprising the holder of claim 7.

47. An architectural covering comprising the holder of claim 8.

48. An architectural covering comprising the holder of claim 9.

49. An architectural covering comprising the holder of claim 10.

50. An architectural covering comprising the holder of claim 11.

51. An architectural covering comprising the holder of claim 12.

52. An architectural covering comprising the holder of claim 13.

53. An architectural covering comprising the holder of claim 14.

54. An architectural covering comprising the holder of claim 15.

55. A holder and louver combination comprising the holder of any one of claims 1–3 and a louver, the louver includes the hollow vertical section, wherein the hollow vertical section is a deformable, generally tubular vane.

56. A holder and louver combination comprising the holder of claim 11 and a louver, the louver includes the hollow vertical section, wherein the louver has three-dimensional and torsional stability along its length.

57. A holder and louver combination comprising the holder of claim 12 and a louver, the louver includes the hollow vertical section, wherein the louver is made of a fabric having diagonal dimensional stability.

58. A holder and louver combination comprising the holder of claim 13 and a louver, the louver includes the hollow vertical section, wherein the apertures are in opposite sides of an upper marginal portion of the hollow vertical section.

59. The holder of claim 4 wherein the top member of the female part is generally rectangular and generally planar.

60. The holder of claim 4 wherein the hole in the top member is rectangular.

61. The holder of claim 16 wherein the top member of the female part is generally rectangular and generally planar.

62. The holder of claim 16 wherein the hole in the top member is rectangular.

63. A vertical blind system comprising:

an elongated substantially horizontal head rail a plurality of hollow substantially vertically-orientated louvers, each louver having a pair of generally spaced apart sides proximate a top end of the louver with an aperture passing through each side of the pair of spaced apart sides proximate the top end;

a plurality of carriers, the plurality of carriers being slidably attached to the head rail; and a plurality of holders, each holder of the plurality of holders including, (i) a substantially vertically-extending male part having upper and lower portions, the upper portion being generally cylindrical and coupled to a carrier of the plurality of carriers, and (ii) a generally inverted U-shaped female part having (a) a generally horizontally-orientated, generally planar top section, the top section including a pair of spaced apart opposite edges and a vertically-extending opening passing therethrough, the lower portion of the male part being received and secured within the opening and, (b) a pair of substantially parallel, downwardly extending legs, each leg of the pair of legs intersecting with an edge of the pair of spaced apart opposite edges, each leg of the pair of legs having a detent extending towards the detent of the other leg of the pair of legs, each detent being received in an aperture of a louver of the plurality of louvers.

64. The vertical blind system of claim 63, wherein the top section is substantially rectangular.

65. The vertical blind system of claim 63, wherein the vertically-extending opening is substantially rectangular.

66. The vertical blind system of claim 63, wherein for each holder the lower portion of the male part extends downwardly between the detents of the pair of legs of the female part.

67. the vertical blind system of claim 63, wherein the detent on each leg of the pair of legs is located proximate a bottom end of the leg.

68. A holder for suspending a vertical louver from a carrier of a vertical blind system, the holder comprising:

a substantially vertically-extending male part having upper and lower portions, the upper portion being generally cylindrical and adapted for coupling to said carrier; and a generally inverted U-shaped female part having (a) a generally horizontal-orientated, generally planar top section, the top section including a pair of spaced apart opposite edge and a vertically-extending opening passing therethrough, the lower portion of the male part being received and secured within the opening and, (b) a pair of substantially parallel, downwardly extending legs, each leg of the pair of legs intersecting with an edge of the pair of opposite edges, each leg of the pair of legs having a detent extending towards the detent of the other leg of the pair of legs.

69. The holder of claim 68, wherein the detent of each leg of the pair of legs is located proximate a bottom end of the leg.

* * * * *